US008978964B1

(12) United States Patent
Ruggiere, Sr.

(10) Patent No.: US 8,978,964 B1
(45) Date of Patent: Mar. 17, 2015

(54) REINFORCED CORRUGATED CONTAINER WITH AN EXTERIOR SLEEVE

(71) Applicant: Thomas S. Ruggiere, Sr., Athens, GA (US)

(72) Inventor: Thomas S. Ruggiere, Sr., Athens, GA (US)

( * ) Notice: Subject to any disclaimer, the term of this patent is extended or adjusted under 35 U.S.C. 154(b) by 94 days.

(21) Appl. No.: 13/833,859

(22) Filed: Mar. 15, 2013

(51) Int. Cl.
*B65D 5/62* (2006.01)
*B65D 5/42* (2006.01)
*B65D 5/44* (2006.01)

(52) U.S. Cl.
CPC ..... *B65D 5/445* (2013.01)
USPC ..... 229/199; 229/164.1

(58) Field of Classification Search
USPC ..... 229/103.11, 164.1, 199
See application file for complete search history.

(56) References Cited

U.S. PATENT DOCUMENTS

| | | | | | |
|---|---|---|---|---|---|
| 1,139,281 | A | | 5/1915 | Hazelton | |
| 2,382,859 | A | * | 8/1945 | Clerc | 229/103.11 |
| 2,502,586 | A | | 4/1950 | Ottinger | |
| 3,123,354 | A | | 5/1960 | Ungerer | |
| 3,638,790 | A | * | 2/1972 | Schmid et al. | 206/446 |
| 3,779,448 | A | | 12/1973 | Wootten | |
| 3,937,392 | A | | 2/1976 | Swisher | |
| 4,115,909 | A | | 9/1978 | Corella | |
| 4,226,327 | A | | 10/1980 | Ballard | |
| 4,362,199 | A | | 12/1982 | Futerman | |
| 4,538,385 | A | | 9/1985 | Kandarian | |
| 4,655,366 | A | * | 4/1987 | Sykes | 229/199 |
| 4,666,059 | A | | 5/1987 | Nordstrom | |
| 4,850,506 | A | | 7/1989 | Heaps, Jr. et al. | |
| 4,868,955 | A | | 9/1989 | Magnant et al. | |
| 4,903,431 | A | | 2/1990 | Stoll | |
| 4,997,125 | A | | 3/1991 | Glerum | |
| 5,285,957 | A | | 2/1994 | Halsell | |
| 5,388,702 | A | * | 2/1995 | Jones | 206/597 |
| 5,704,193 | A | | 1/1998 | Roe et al. | |
| 5,772,108 | A | | 6/1998 | Ruggiere et al. | |
| 6,074,331 | A | | 6/2000 | Ruggiere, Sr. et al. | |
| 6,431,435 | B1 | * | 8/2002 | Jones et al. | 229/199 |
| RE38,631 | E | | 10/2004 | Ruggiere, Sr. et al. | |
| 6,932,266 | B2 | | 8/2005 | Jones et al. | |
| 7,604,156 | B2 | * | 10/2009 | Clohessy | 229/199 |
| 7,628,310 | B2 | * | 12/2009 | Perkins | 229/199 |
| 8,562,212 | B1 | * | 10/2013 | Strickland et al. | 220/495.11 |
| 2006/0273145 | A1 | * | 12/2006 | Barner | 229/199 |
| 2008/0041755 | A1 | * | 2/2008 | Noschang et al. | 206/494 |
| 2008/0142380 | A1 | * | 6/2008 | Unruh et al. | 206/170 |

* cited by examiner

*Primary Examiner* — Gary Elkins
(74) *Attorney, Agent, or Firm* — Allen, Dyer, Doppelt, Milbrath & Gilchrist, P.A.

(57) ABSTRACT

A reinforced corrugated container includes a bin having a rigid longitudinal sidewall made of a plurality of corrugated parallel adjacent connected panels radially defining a interior hollow space for receiving bulk material that applies a radial outward force against the sidewall when placed therein. The longitudinal sidewall extends from a bottom edge to a top edge that defines a rim of the interior hollow space. A flexible tubular sleeve made of non-woven material closely is continuously radially engaged with and around an exterior of the sidewall for providing a radial inward force against the sidewall to oppose the radial outward force. The container may also include a plurality of straps for additional girth support.

15 Claims, 5 Drawing Sheets

REINFORCED CORRUGATED CONTAINER WITH AN EXTERIOR SLEEVE

FIELD OF THE INVENTION

The invention relates generally to collapsible containers constructed of corrugated material and, more particularly, corrugated containers reinforced with an outer sleeve.

BACKGROUND

Historically the packaging and transport of bulk items has been accomplished through the use of octagonally shaped bulk containers. Such bulk items include meats, vegetables, fruits, granular materials, animal parts, and liquids, which are all somewhat flowable to one extent or another. This flowability presents special problems to the shipping and storage industries because movement of the material during shipping or storage can make the container unstable and prone to rupture.

One solution to reinforcing bulk material containers is to apply horizontal straps around the container to provide lateral girth support. An example of such a container is described in U.S. Pat. No. 5,772,108. Although that container is effective for most applications, it can still be improved.

Another technique for reinforcing the outer wall of a bulk material container is to place a sleeve made of a woven material along the outer surface of the container for providing lateral girth support to the container. An example of this type of container is described in U.S. Pat. Nos. 6,431,435 and 6,932,266. Although this type of container is also effective, it is not without its drawbacks.

SUMMARY OF THE INVENTION

It is an object of the invention to provide an improved corrugated bulk material container having an outer reinforcing sleeve made of non-woven material fitted substantially around a corrugated bin. The non-woven sleeve provides girth support to the bin and is also less prone to fraying and snagging compared to containers with woven-material sleeves. The non-woven sleeve is also substantially liquid impermeable.

In a particular embodiment, the reinforced corrugated container includes a bin having a rigid longitudinal sidewall made of a plurality of corrugated parallel adjacent connected panels radially defining a interior hollow space for receiving bulk material that applies a radial outward force against the sidewall when placed therein. The longitudinal sidewall extends from a bottom edge to a top edge that defines a rim of the interior hollow space. A flexible tubular sleeve made of non-woven material closely is continuously radially engaged with and around an exterior of the sidewall for providing a radial inward force against the sidewall to oppose the radial outward force. The container may also include a plurality of straps for additional girth support. A preferred non-woven material for the sleeve is a polyethylene material made from a plurality of randomly oriented polyethylene fibers.

These and other aspects, embodiments, features, and advantages of the invention will be better understood with reference to the accompanying drawings and the detailed description of preferred embodiments that follows.

DETAILED DESCRIPTION OF PREFERRED EMBODIMENT

The invention will now be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will convey preferred embodiments of the invention to those skilled in the art.

A drawback associated with containers that include an outer sleeve made of woven material is that the weaves in the woven material are prone to being snagged by adjacent items and the peripheral edges of the woven material are prone to fraying. This limits the durability of these containers and may also result in some of the woven material coming loose and falling into the bulk items in the container.

Figure 1:
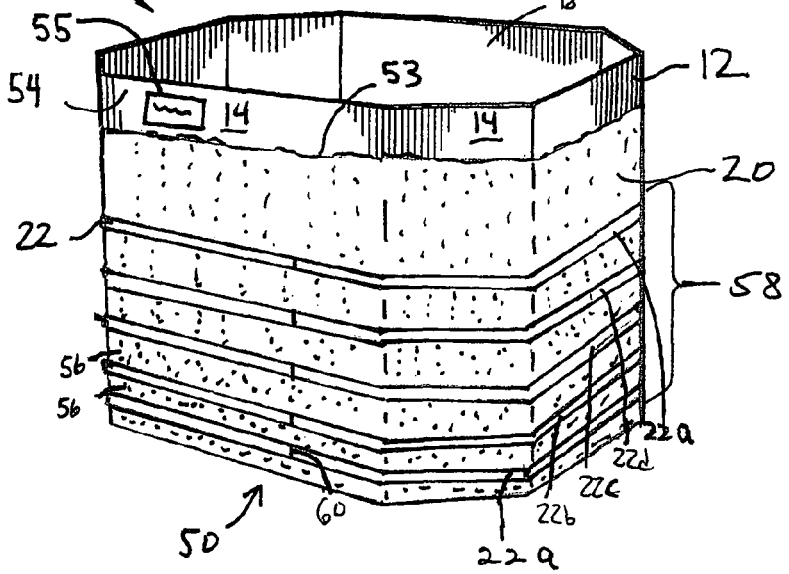
FIG. 1 is a perspective view of a reinforced corrugated container according an embodiment of the invention.

Referring to FIG. 1, a reinforced corrugated container 10, according to an embodiment of the invention includes a corrugated bin 12 formed from a plurality of parallel panels 14 arranged together to define a hollow space 18 for receiving bulk material therein. A non-woven sleeve 20 wraps around the bin 12. In the preferred embodiment shown, the sleeve 20 is position between the bin 12 and a plurality of optional reinforcement straps 22 extend horizontally around the bin 12 for providing lateral reinforcement to the bin 12 when loaded with bulk material. In this arrangement, the straps 22 are held by enough tension to frictionally hold the sleeve to the bin 12.

As shown in this embodiment, the straps 22 are placed along the exterior of the sleeve 20 such that the sleeve 20 is positioned between the bin 12 and straps 22. In other embodiments, the sleeve 20 is placed exterior from the straps 22 so that the straps 22 are between the bin 12 and the sleeve 20. The sleeve 20 fits closely around the bin 12 to provide additional lateral girth support thereto. When the straps 22 are in place, the sleeve 20 provides girth support in the area between the straps 22.

Figure 2:
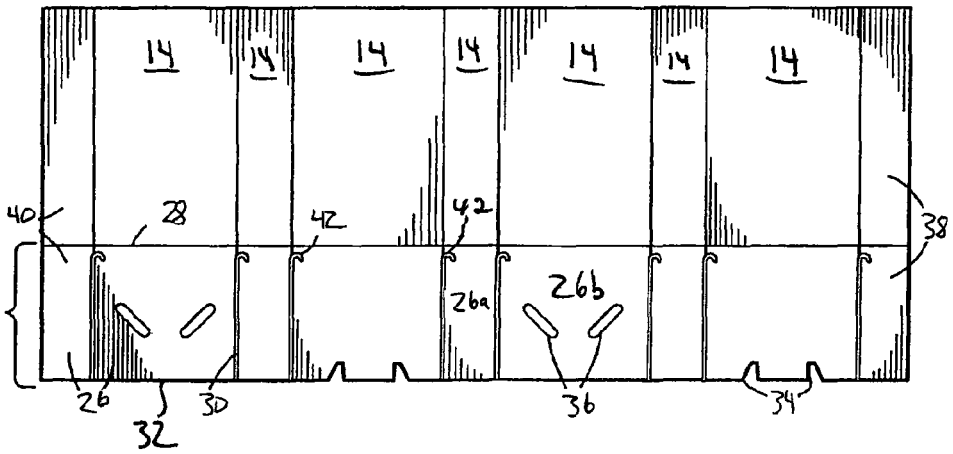
FIG. 2 is a plan view of a flat blank forming an unassembled container prior to assembly to the erected arrangement.

With reference now to FIGS. 1-4, additional details of the bin 12 are discussed. As best shown in FIG. 2, the bin 12 is formed from a flat blank 24 of the corrugated material. The flat blank 24 is scored between adjacent panels 14 to allow the panels 14 to be folded to form the bin 12, however, the adjacent panels 14 are still joined to one another along adjacent sides. Each panel 14 has a flap 26 extending from a juncture 28 in prolongation of the panel 14. Each panel 14 is scored or creased its juncture 28 with its associated flap 26.

Adjacent flaps 26*a*, 26*b*, by way of example, are separated from one another by a slit 30, allowing the panels 14 and flaps 26 to be folded inwardly to one another for forming the hollow space 18 with the flaps 26 at the panel ends 32 overlaying one another, and flap tabs 34 inserted into cooperating slots 36. To form the bin 12, end panels 38, 40 are overlayed and joined together using a fastening means such as adhesive, staples, or the like to form a joint 41. The upper end of each slit 30 includes a hook shaped slit portion 42.

Figure 3:
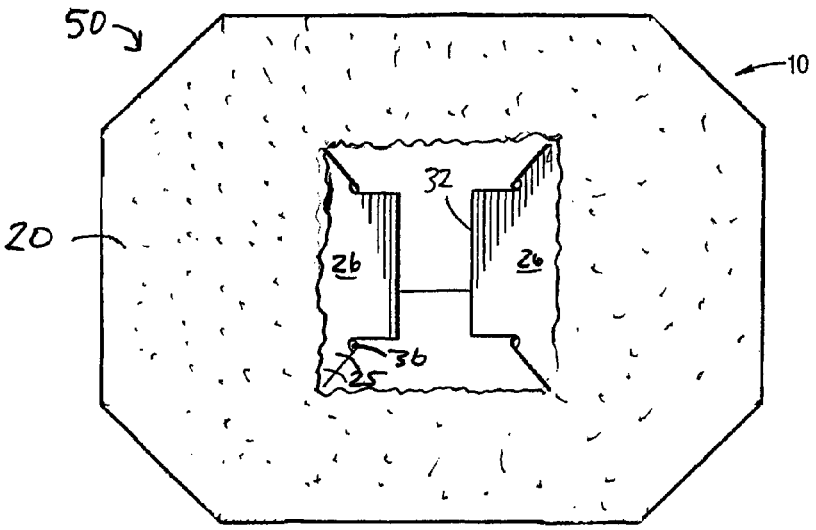
FIG. 3 is a bottom plan view of an erected container illustrating the interlocking tabs and slots of folded flaps.

In a preferred embodiment, the container 10 is formed having eight panels 14 to provide an octagonal shape. The octagonal container 10 has panels 14 and associated flaps 26 of varying width, as shown in FIGS. 1 and 2. The flaps 26 further have a length 46 for providing an overlap 48 when the container 10 is in the erected position, as shown in FIG. 3. In this way, gaps between typical container overlapping flaps are eliminated.

Figure 5A:
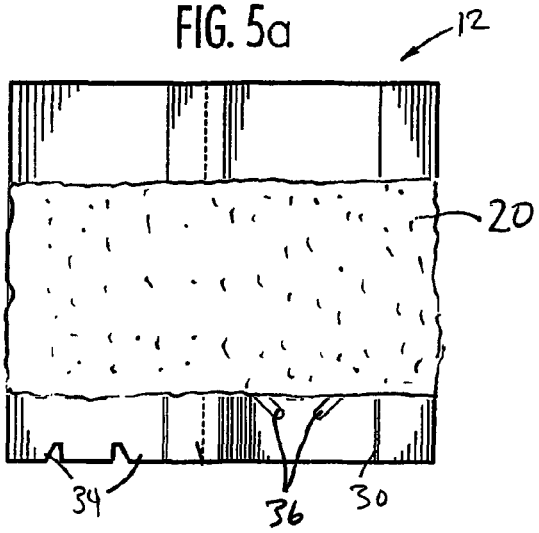
FIG. 5*a* is a side view of an unstrapped container in a flat arrangement.

To form the bin 12 the end panels 38, 40 are fastened together to form a continuous arrangement of adjoining inwardly folded panels 14, as illustrated in FIG. 5*a*. The joint 41 is approximately four inches wide in the preferred embodiment of and vertically disposed when the bin 12 is in an erected arrangement.

In the erected arrangement, as shown in FIGS. 1-4, the sleeve 20 extends onto the flaps 26. As best shown in FIG. 3, when the flaps 26 are folded inwardly the sleeve 20 is held in place on the bottom 50 by being tucked into the slots 36 beneath the tabs 25. In this manner, the interlocking tabs and slots hold the sleeve in place on the bottom side 50 because the sleeve 20 is positioned beneath the tabs 25 within the slots 36.

Figure 4:
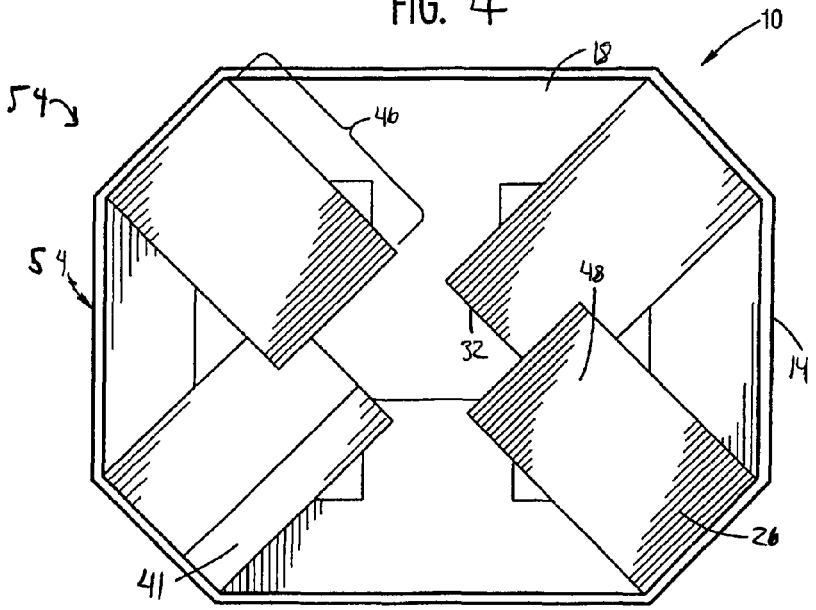
FIG. 4 is a top plan view of a container illustrating overlaying folded flaps within the hollow space for preventing container bottom wall gaps.

Although, the bin 12 is shown with flaps 26 on a bottom side 50 and an open top side 52, as illustrated in FIGS. 3 and 4, it should be noted that the flaps 26 may alternatively be from both top and bottom sides.

The straps 22 are preferably made of flexible plastic for providing girth support when the container 10 is in an erected position. The straps 22 are frictionally held in tension around the container vertical side wall 54. The girth support is provided by the horizontally placed straps 22 at longitudinally spaced locations 56 along the panels 14. Each location 56 has a greater separation than the separation from the adjacent lower location when the container 10 is in its erected arrangement for providing greater support at lower portions 58 of the container 12.

As an example only, the container 10 of FIG. 1, may have the lowest strap 22*a* positioned at two and one half inches from the bottom side 50, with additional straps 22*b*-22*e* separated by distances of three and one half, five, six, and eight inches respectively. Such separations will vary based on the container size and products being stored therein.

In a preferred embodiment of the invention, the straps 22 are polypropylene plastic or of a polyester-type material which are thermally fused or welded together at their ends 60 which secures the straps 22 in sufficient tension outside the container panels 14 for frictionally holding the straps 22 to the container 10. In certain embodiments, the straps 22 are polypropylene straps that are pre-stretched to provide a low elongation factor and to reduce typical stretching by approximately fifty percent. The straps 22 in a preferred embodiment are of the low elongation type and have a breaking strength rating of 700 pounds per square inch. Further, the straps 22 used for the containers 10 herein described typically have a width ranging from ¼" to ".

Figure 6A:
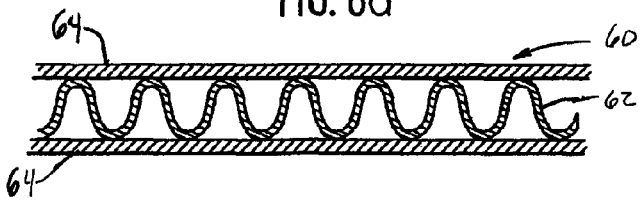
FIGS. 6*a* and 6*b* are partial cross sectional views illustrating single and double wall corrugated paperboard.
Figure 6B:
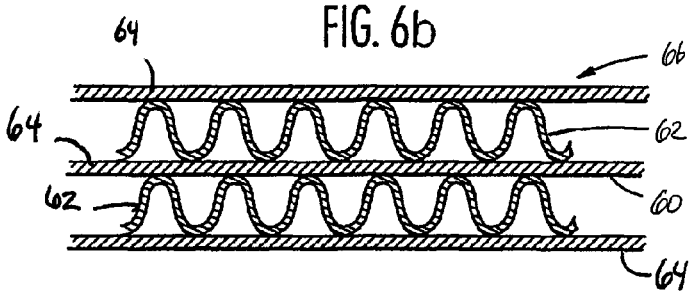

Referring now to FIGS. 6*a* and 6*b*, the bin 12 is preferably fabricated from single wall corrugated paperboard 60 and/or double wall corrugated paperboard 66. As illustrated, the single wall paper board 60 includes a corrugated medium or flute 62 sandwiched between two liners 64. The double wall paperboard 66 includes three liners 64 and two flutes 62. By using the straps 22, single or double wall paperboard may be used in containers that typically require triple wall and multiple single wall laminated structures. In a preferred embodiment, the panels 14 are formed with the corrugations within the flute 62 positioned perpendicular to the straps 22.

The placement of the straps 22 and number of straps depend on the product packed and the depth of container. The straps 22 are preferably applied perpendicular to corrugation direction, as described, and the ends 60 are secured by a heat seal. Although the strap tension should not cause the container sidewalls 54 to bow, the tension should be sufficient such that the straps 22 do not slide off during assembly of the container 10 to its erected arrangement and do not allow the sleeve 20 to slide off either.

Figure 5B:
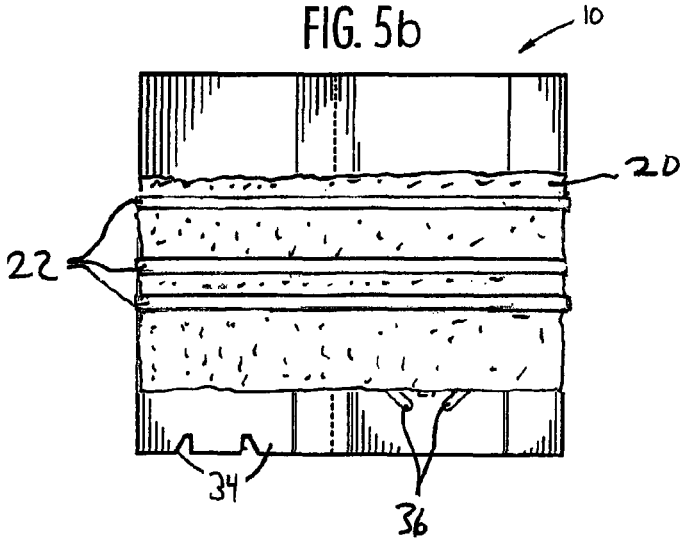
FIG. 5*b* is a side view of a strapped container in a flat arrangement.
Figure 7:
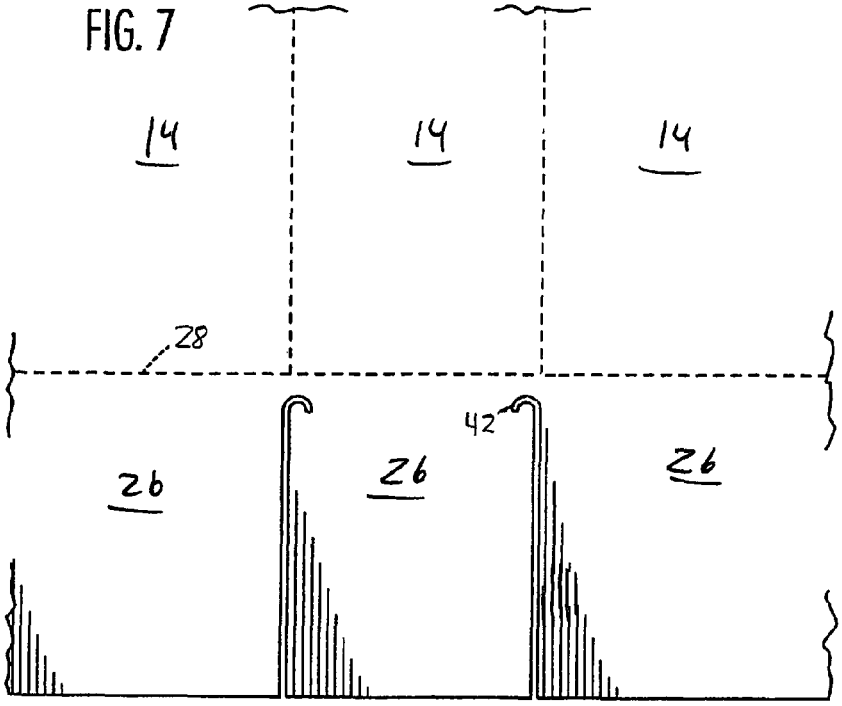
FIG. 7 is a partial plan view of a corrugated material having score lines and slits.

Turning now to FIGS. 5*a*, 5*b*, and the enlarged panel 14 and flap 26 view in FIG. 7, the slits 30 separating the flaps 26 terminate in the hook shape slit portion 42. The hook shape slit portion 42 is spaced from associated junctures 28 as illustrated shown in FIG. 7. A reverse five point score is used at the juncture 28 to prevent slight fracturing of the juncture 28 when flaps 26 are folded. This condition becomes evident primarily when using very heavy liners in the container 10. A system that can be used to apply the straps is described in U.S. Pat. No. 5,772,108, which is incorporated by reference in its entirety.

Technology and experience permits a determination of exact strap placement depending on the type of product being packaged and shipped. Although a vast amount of current users package product that tends to settle down into the container requiring more strapping towards the bottom, some product supports its own weight but bulges towards the outside evenly through the depth of the container. Citrus, melons and produce give this effect thereby requiring a more even distribution of straps 22 through the depth.

It should be understood that the straps 22 do not necessarily need to be spaced closer together near the bottom 52. Although this is the preferred embodiment, the straps 22 may alternatively be placed at more or less equidistant spacing therebetween, or may be placed closer together near the top 50.

Figure 8:
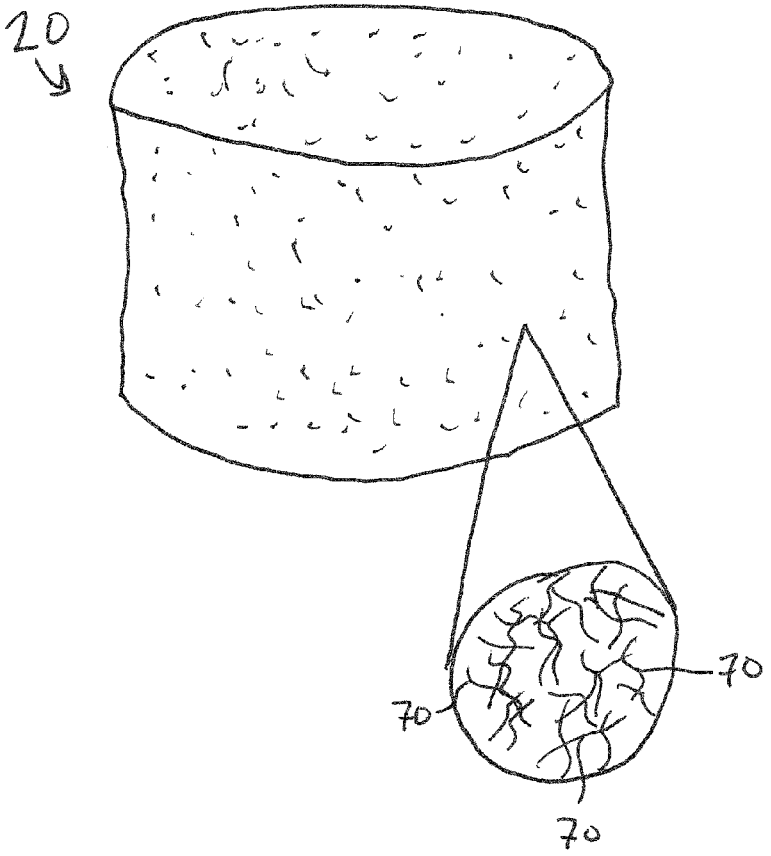
FIG. 8 is a perspective view of a non-woven material sleeve where the inset shows the random orientation of the fibers forming the sleeve.

Referring to FIG. 8, the sleeve 20 is preferably tubular in shape and made of a polymeric non-woven material that is impermeable to liquid. The preferred material is non-woven high-density polyethylene made of a plurality of non-directionally aligned, or randomly oriented, fibers 70 that are spun together and bonded under heat and pressure. An example of this material is DuPont's TYVEK®. The sleeve 20 is advantageous when used in connection with the straps 22 because it provides a substantially liquid impermeable barrier around the bin 12. Use of the non-woven high-density polyethylene is advantageous because such a material is substantially smooth on the outer surface, making it less likely to snag, which could lead to leakage and reduce the integrity of the container 10.

As shown in FIG. 1, when the container 10 is erected, the sleeve 22 wraps completely around the bin 12 and extends from the bottom side 50 upwardly towards the top side 52. The sleeve 22 terminates before reaching the top side 52 along an upper sleeve edge 53, leaving a portion of the panels 14, along the top side 52 exposed. Leaving a portion of the panels 14 along the top side 52 exposed is particularly advantageous because it allows for the bin 12 to be labeled along the top side 52 without the need to print on the sleeve 20. When the bin 12 itself is labeled, the label will be visible; otherwise, the sleeve 20 would cover the label. It is much less efficient to label the sleeve 20 instead of the bin 12. The embodiment shown in FIG. 1 includes a label 55 on the bin 12 above the upper sleeve edge 53, which is positioned about 6 inches to about 24 inches below the upper rim.

The reinforced corrugated container will particularly be useful in connection with the poultry industry, where there is a need to ship chicken and turkey, MDM meat, breast beat, whole birds, frames and bones. In addition, shippers in the red meat industry, pork industry, citrus industry, produce industry, and ICE Industry will also realize great benefit when using such a reinforced container as herein described.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

That which is claimed is:

1. A reinforced corrugated container comprising:

a bin having a rigid longitudinal sidewall made of a plurality of corrugated parallel adjacent connected panels radially defining a interior hollow space for receiving bulk material that applies a radial outward force against the sidewall when placed therein, the longitudinal sidewall extending longitudinally from a bottom edge to a top edge, the top edge defining a rim of the interior hollow space; and a flexible tubular sleeve made of non-woven material closely and continuously radially engaged with and around an exterior of the sidewall for providing a radial inward force against the sidewall to oppose the radial outward force;

wherein each parallel panel includes a flap extending from the bottom edge and each flap is inwardly folded and secured together by a plurality of interlocking tabs and slots to form a bottom of the bin; and wherein a portion of the sleeve is positioned beneath the tabs and within the slots for holding the sleeve in place on the bottom.

2. The reinforced corrugated container of claim 1, further comprising a plurality of straps for providing radial inward girth support to the bin, the straps being continuously engaged about the exterior of the sidewall and disposed longitudinally at spaced locations along the sidewall.

3. The reinforced corrugated container of claim 2, wherein the sleeve is positioned between the straps and the sidewall in contact with the exterior of the sidewall.

4. The reinforced corrugated container of claim 3, wherein the straps are held in tension against the sleeve, the tension sufficient for frictionally holding the sleeve to the sidewall.

5. The reinforced corrugated container of claim 1, wherein the sleeve terminates at an upper sleeve edge wrapping radially around the bin below the upper rim.

6. The reinforced corrugated container of claim 1, wherein the sleeve comprises a non-woven polyethylene material including a plurality of randomly oriented polyethylene fibers.

7. A reinforced corrugated container comprising:

a bin made of corrugated material, the bin having an open top defined by a rigid longitudinal radial sidewall and a closed bottom defined by a plurality of flaps folded inwardly from the sidewall and joined together about a center of the bin;

a flexible tubular sleeve made of non-woven material closely and continuously radially engaged with and around an exterior of the bin for providing radial inward girth support to the bin, the sleeve extending from the closed bottom toward an upper rim formed along the sidewall defining the open top, the sleeve terminating at an upper sleeve edge positioned between the closed bottom and upper rim; and a plurality of straps continuously and tightly formed radially about an exterior of the sidewall and disposed longitudinally at spaced locations along the sidewall for providing girth support to the bin;

wherein the sleeve comprises a non-woven polyethylene material including a plurality of randomly oriented polyethylene fibers.

8. The reinforced corrugated container of claim 7, wherein the sleeve is positioned in contact with the sidewall and is located between the straps and the sidewall.

9. The reinforced corrugated container of claim 8, wherein the straps are held in tension outside the sleeve, the tension sufficient for frictionally holding the sleeve to the sidewall.

10. The reinforced corrugated container of claim 7, wherein the upper sleeve edge extends radially around the bin and is substantially parallel with the upper rim.

11. The reinforced corrugated container of claim 7, wherein the flaps are secured together on the bottom by a plurality of interlocking tabs and slots and the sleeve is positioned beneath the tabs and within the slots.

12. A reinforced paperboard container moveable from a flatted configuration to an erected configuration, the container comprising:

panels formed from a flat blank of corrugated paperboard scored to form multiple parallel panels joined to one another along adjacent sides, the flat blank having connected opposing end panels for forming a continuous panel arrangement while the container is in both a flattened arrangement and an erected arrangement, each panel having a flap extending from an end in prolongation of the panel, each panel being foldable at its juncture with its associated flap and adjacent flaps being separated from one another by a slit, whereby the panels and flaps are foldable inwardly toward one another for forming a hollow space having a generally vertical sidewall when in the erected arrangement;

a sealed glue joint connecting opposing end panels for forming a continuous panel arrangement while the container is in both a flattened arrangement and an erected arrangement, the joint being vertically disposed when the container is in the erected arrangement;

multiple straps for providing girth support to the container, each strap positioned along an outside surface of the container vertical sidewall in a supporting arrangement therewith, each strap continuously formed for providing horizontal girth support at longitudinally spaced locations along the panels forming the container sidewall, wherein the spaced locations have a greater separation from an adjacent lower location when the container is in its erected position; and a flexible tubular sleeve made of non-woven material closely and continuously radially engaged with and around an exterior of the sidewall for providing radial inward girth support to the sidewall, the sleeve extending from the closed bottom toward an upper rim formed along the sidewall defining the open top, the sleeve terminating at an upper sleeve edge positioned between the closed bottom and upper rim;

wherein the straps are held in tension outside the sleeve, the tension sufficient for frictionally holding the sleeve to the container; and wherein the flaps are secured together on the bottom side by a plurality of interlocking tabs and slots and the sleeve is positioned beneath the tabs and within the slots.

13. The reinforced corrugated container of claim 12, wherein the sleeve comprises a non-woven polyethylene material including a plurality of randomly oriented polyethylene fibers.

14. A reinforced corrugated container comprising:

a bin having a rigid longitudinal sidewall made of a plurality of corrugated parallel adjacent connected panels radially defining a interior hollow space for receiving bulk material that applies a radial outward force against the sidewall when placed therein, the longitudinal sidewall extending longitudinally from a bottom edge to a top edge, the top edge defining a rim of the interior hollow space; and a flexible tubular sleeve made of non-woven material closely and continuously radially engaged with and around an exterior of the sidewall for providing a radial inward force against the sidewall to oppose the radial outward force;

wherein the sleeve comprises a non-woven polyethylene material including a plurality of randomly oriented polyethylene fibers.

15. A reinforced corrugated container comprising:

a bin made of corrugated material, the bin having an open top defined by a rigid longitudinal radial sidewall and a closed bottom defined by a plurality of flaps folded inwardly from the sidewall and joined together about a center of the bin;

a flexible tubular sleeve made of non-woven material closely and continuously radially engaged with and around an exterior of the bin for providing radial inward girth support to the bin, the sleeve extending from the closed bottom toward an upper rim formed along the sidewall defining the open top, the sleeve terminating at an upper sleeve edge positioned between the closed bottom and upper rim; and a plurality of straps continuously and tightly formed radially about an exterior of the sidewall and disposed longitudinally at spaced locations along the sidewall for providing girth support to the bin;

wherein the flaps are secured together on the bottom by a plurality of interlocking tabs and slots and the sleeve is positioned beneath the tabs and within the slots.

* * * * *